US007048361B2

(12) United States Patent
Schmachtenberg, III et al.

(10) Patent No.: US 7,048,361 B2
(45) Date of Patent: May 23, 2006

(54) INK JET APPARATUS

(75) Inventors: Richard Schmachtenberg, III, Aloha, OR (US); John R. Andrews, Fairport, NY (US); Cathie J. Burke, Rochester, NY (US); Peter J. Nystrom, Webster, NY (US)

(73) Assignee: Xerox Corporation, Stamford, CT (US)

( * ) Notice: Subject to any disclaimer, the term of this patent is extended or adjusted under 35 U.S.C. 154(b) by 371 days.

(21) Appl. No.: 10/702,247

(22) Filed: Nov. 5, 2003

(65) Prior Publication Data

US 2005/0093929 A1 May 5, 2005

(51) Int. Cl.
*B41J 2/14* (2006.01)
*B41J 2/16* (2006.01)

(52) U.S. Cl. ..... 347/71; 29/890.1

(58) Field of Classification Search ..... None
See application file for complete search history.

(56) References Cited

U.S. PATENT DOCUMENTS

| | | | | |
|---|---|---|---|---|
| 4,516,140 A | | 5/1985 | Durkee et al. | |
| 4,680,595 A | * | 7/1987 | Cruz-Uribe et al. | 347/40 |
| 4,695,854 A | * | 9/1987 | Cruz-Uribe | 347/40 |
| 4,703,333 A | * | 10/1987 | Hubbard | 347/40 |
| 4,730,197 A | * | 3/1988 | Raman et al. | 347/40 |
| 5,394,179 A | | 2/1995 | Vadagriff et al. | |
| 6,019,457 A | | 2/2000 | Silverbrook | |
| 6,532,028 B1 | | 3/2003 | Gailus et al. | |
| 2005/0093930 A1 | * | 5/2005 | Andrews et al. | 347/54 |

FOREIGN PATENT DOCUMENTS

| | | |
|---|---|---|
| EP | 0629007 | 12/1994 |
| EP | 0887187 | 12/1998 |

OTHER PUBLICATIONS

European Patent Office, European Search Report for Application No. EP04026226, Feb. 9, 2005, 4 pages, Search performed in The Hague.

Steven A Buhler, et al.; U.S. Appl. No 10/664,472; Filing date: Sep. 16, 2003.

* cited by examiner

*Primary Examiner*—Huan Tran
(74) *Attorney, Agent, or Firm*—Manuel Quiogue

(57) ABSTRACT

A drop emitting apparatus including a diaphragm layer disposed on a fluid channel layer, a roughened bonding region formed on a surface of the diaphragm layer, a thin film circuit having conformal raised contact regions disposed on the bonding region, and a plurality of electromechanical transducers adhesively attached to the raised contact regions and electrically connected to the conformal raised contact regions by asperity contacts formed between the conformal raised contact regions and the electromechanical transducers.

55 Claims, 4 Drawing Sheets

INK JET APPARATUS

BACKGROUND OF THE DISCLOSURE

The subject disclosure is generally directed to drop emitting apparatus, and more particularly to ink jet apparatus.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

A known ink jet printhead structure employs electromechanical transducers that are attached to a metal diaphragm plate, and it can be difficult to make electrical connections to the electromechanical transducers.

DETAILED DESCRIPTION OF THE DISCLOSURE

Figure 1:
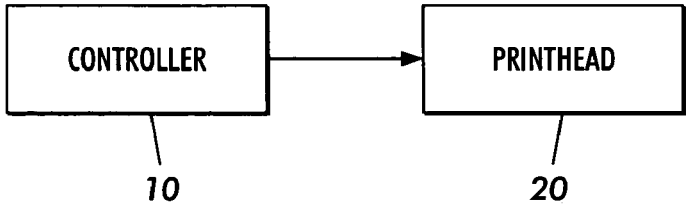
FIG. 1 is a schematic block diagram of an embodiment of a drop-on-demand drop emitting apparatus.

FIG. 1 is a schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer such as a ceramic piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
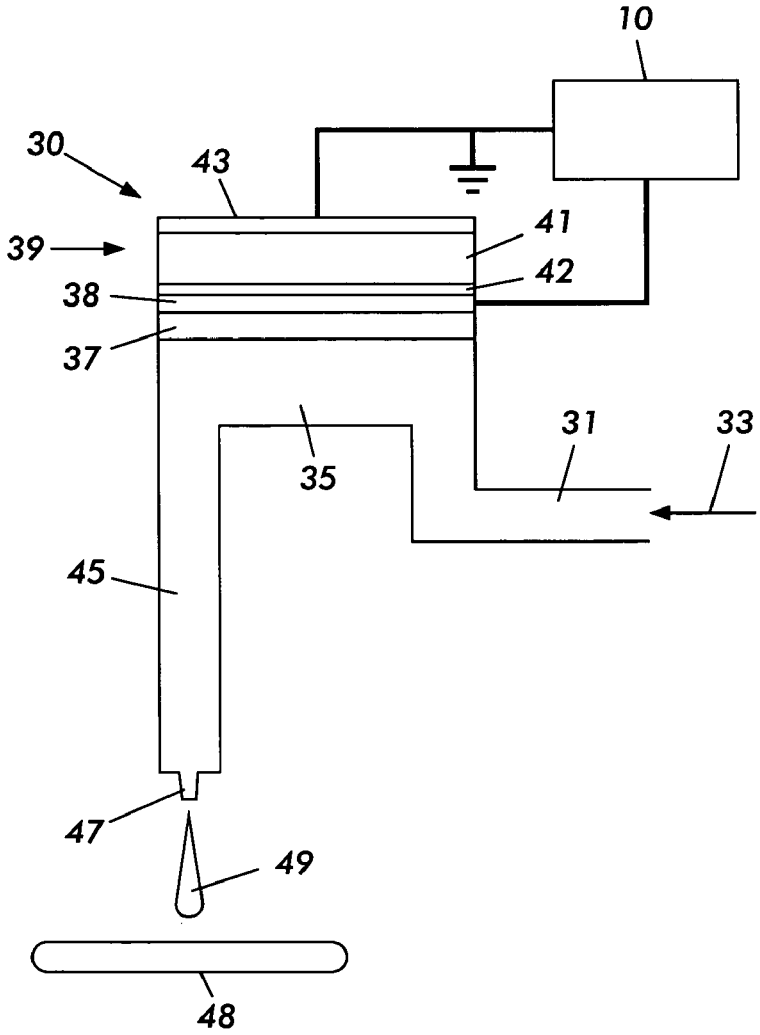
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an inlet channel 31 that receives ink 33 from a manifold, reservoir or other ink containing structure. The ink 33 flows into a pressure or pump chamber 35 that is bounded on one side, for example, by a flexible diaphragm 37. A thin-film interconnect structure 38 is attached to the flexible diaphragm, for example so as to overlie the pressure chamber 35. An electromechanical transducer 39 is attached to the thin film interconnect structure 38. The electromechanical transducer 39 can be a piezoelectric transducer that includes a piezo element 41 disposed for example between electrodes 42 and 43 that receive drop firing and non-firing signals from the controller 10 via the thin-film interconnect structure 38, for example. The electrode 43 is connected to ground in common with the controller 10, while the electrode 42 is actively driven to actuate the electromechanical transducer 41 through the interconnect structure 38. Actuation of the electromechanical transducer 39 causes ink to flow from the pressure chamber 35 to a drop forming outlet channel 45, from which an ink drop 49 is emitted toward a receiver medium 48 that can be a transfer surface, for example. The outlet channel 45 can include a nozzle or orifice 47.

The ink 33 can be melted or phase changed solid ink, and the electromechanical transducer 39 can be a piezoelectric transducer that is operated in a bending mode, for example.

Figure 3:
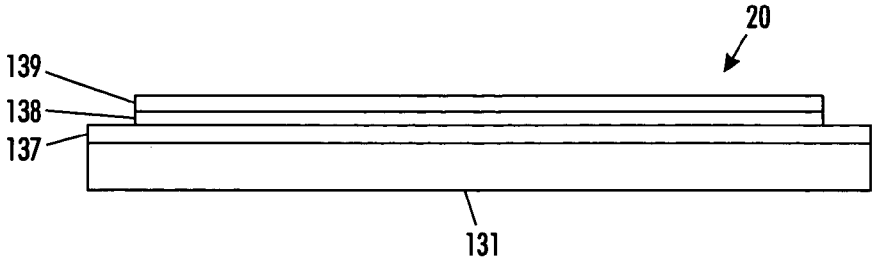
FIG. 3 is a schematic elevational view of an embodiment of an ink jet printhead assembly.

FIG. 3 is a schematic elevational view of an embodiment of an ink jet printhead assembly 20 that can implement a plurality of drop generators 30 (FIG. 2), for example as an array of drop generators. The ink jet printhead assembly includes a fluid channel layer or substructure 131, a diaphragm layer 137 attached to the fluid channel layer 131, a thin-film interconnect circuit layer 138 disposed on the diaphragm layer 137 and a transducer layer 139 attached to the thin-film interconnect circuit layer 138. The fluid channel layer 131 implements the fluid channels and chambers of the drop generators 30, while the diaphragm layer 137 implements the diaphragms 37 of the drop generators. The thin-film interconnect circuit layer 138 implements the interconnect circuits 38, while the transducer layer 139 implements the electromechanical transducers 39 of the drop generators 30.

By way of illustrative example, the diaphragm layer 137 comprises a metal plate or sheet such as stainless steel that is attached or bonded to the fluid channel layer 131. The diaphragm layer 137 can also comprise an electrically non-conductive material such as a ceramic. Also by way of illustrative example, the fluid channel layer 131 can comprise multiple laminated plates or sheets. The transducer layer 139 can comprise an array of kerfed ceramic transducers that are attached or bonded to the thin film interconnect circuit layer 138 by a suitable adhesive. As described further herein, asperity contacts are more particularly formed between the transducer layer 139 and the thin film interconnect layer 138, and the adhesive can comprise a low conductivity adhesive. For example, an epoxy, acrylic, or phenolic adhesive can be used.

Figure 4:
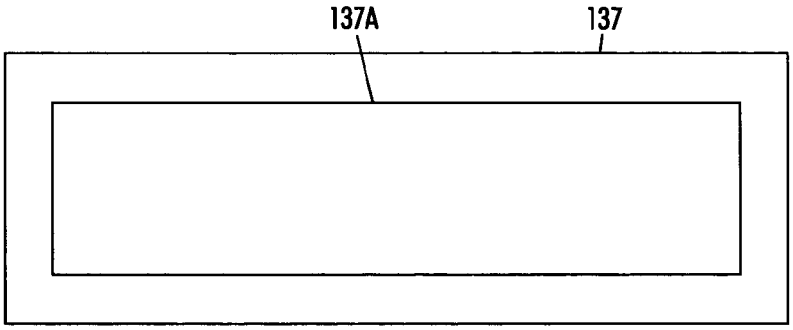
FIG. 4 is a schematic plan view of an embodiment of a diaphragm layer of the ink jet printhead assembly of FIG. 3.

FIG. 4 is a schematic plan view of an embodiment of a diaphragm layer 137 that includes a roughened, non-smooth bonding region 137A formed by particle blasting such as sand blasting, or by laser roughening, for example. The bonding region 137A can have a roughness average (Ra) in the range of about 1 microinch to about 100 microinches, for example. As another example, the bonding region 137A can have a roughness average in the range of about 5 microinches to about 20 microinches. Still further, the bonding region 137A can have a roughness average in the range of about 50 microinches to about 100 microinches.

Figure 5:
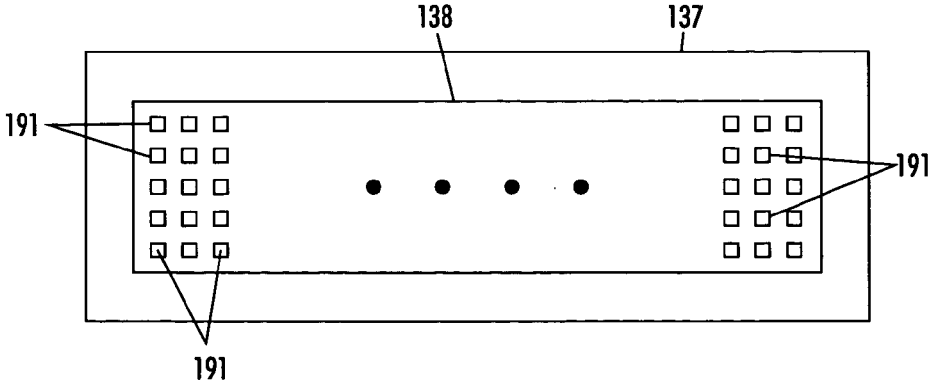
FIG. 5 is a schematic plan view of an embodiment of a thin film interconnect circuit of the ink jet printhead assembly of FIG. 3.

FIG. 5 is a schematic plan view of an embodiment of a thin film interconnect circuit layer 138 that includes conformal raised contact pads or regions 191 disposed over the roughened bonding region 137A (FIG. 4) of the diaphragm layer 137, wherein top surfaces of the raised contact regions 191 have a roughness that generally conforms to the roughness of the underlying roughened bonding region 137A of the diaphragm layer 137. The electromechanical transducers 39 (FIGS. 6–10) are attached to respective conformal raised contact pads 191 by a thin layer of adhesive, and asperity contacts are formed between the top surfaces of the raised contact portions 191 and the electromechanical transducers 39. As disclosed in various embodiments illustrated in FIGS. 6–10, the conformal raised contact regions 191 can be formed by a thin film structure that can include for example a mesa layer and a patterned conductive layer. The layers of the thin film stack that form the conformal raised contact regions 191 are preferably conformal such that the top surfaces of the raised contact regions 191 have a roughness that generally conforms to the roughness of the underlying roughened bonding region 137A of the diaphragm layer 137. By way of illustrative example, the top surfaces of the conformal raised contact regions 191 have a roughness average (Ra) in the range of about 1 microinch to about 100 microinches, which can be achieved for example by configuring the roughened bonding region 137A to have a suitable roughness. As another example, the top surfaces of the conformal raised contact regions 191 can have a roughness average in the range of about 5 microinches to about 20 microinches. Still further, the top surfaces of the raised conformal contact regions 191 can have a roughness average in the range of about 30 microinches to about 80 microinches. The thin film interconnect circuit 138 can provide for electrical interconnection to the individual electromechanical transducers 39.

Figure 6:
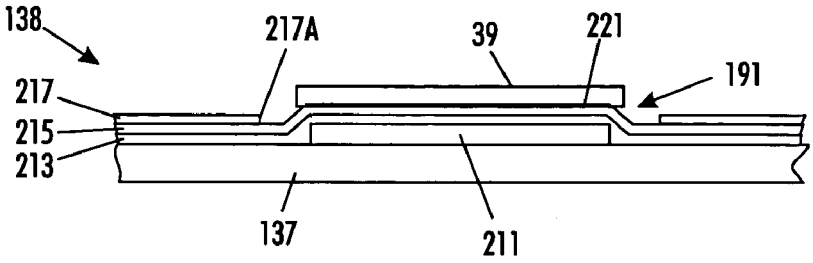
FIG. 6 is a schematic elevational sectional view of a portion of an embodiment of a thin film interconnect circuit of the ink jet printhead assembly.

FIG. 6 is a schematic elevational sectional view of a portion of an embodiment of a thin film interconnect circuit layer 138 that can be used with an electrically conductive or non-conductive diaphragm layer 137. The thin film interconnect circuit layer 138 includes a conformal mesa layer 211 comprising a plurality of mesas, a conformal blanket dielectric layer 213 overlying the mesa layer 211 and the diaphragm layer 137, and a patterned conformal conductive layer 215 disposed on the blanket dielectric layer 213. The blanket dielectric layer serves to electrically isolate the diaphragm layer 137 from the patterned conformal conductive layer 215. The mesa layer 211 can be electrically non-conductive (e.g., dielectric) or conductive (e.g., metal). The mesas and the overlying portions of the conformal blanket dielectric layer 213 and the patterned conformal conductive layer 215 form raised contact regions or pads 191. The thin film interconnect circuit layer 138 can further include a patterned dielectric layer 217 having openings 217A through which the raised contact pads 191 extend. The raised contact pads 191 are higher than the other layers of the thin film interconnect circuit layer 138, and comprise the highest portions of the interconnect layer 138. This facilitates the attachment of an electromechanical transducer 39 to each of the raised contact pads 191.

In the embodiment of a thin film interconnect circuit schematically depicted in FIG. 6, the conformal mesa layer 211 can comprise a suitably patterned conformal dielectric layer or conformal metal layer, for example. The patterned conformal conductive layer 215 can comprise a patterned conformal metal layer.

Since the mesa layer 211, the blanket dielectric layer 213 and the patterned conductive layer 215 are conformal layers, the top surfaces of the raised contact pads 191 have a roughness that generally conforms to the roughened surface of the bonding region 137A of the metal diaphragm 137. In other words, the top surfaces of the raised contact pads 191 comprise roughened surfaces. The electromechanical transducers 39 are attached to respective contact pads 191 by a thin adhesive layer 221 that is sufficiently thin such that asperity contacts are formed between the top surface of the contact pads and the electromechanical transducers 39. Asperity contacts are more particularly formed by high points of the contact pads 191 that pass through the thin adhesive layer and contact the electromechanical transducers 39.

Figure 7:
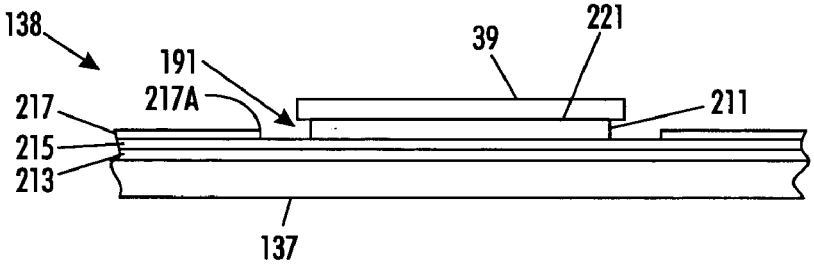
FIG. 7 is a schematic elevational sectional view of a portion of another embodiment of a thin film interconnect circuit of the ink jet printhead assembly.

FIG. 7 is a schematic elevational sectional view of a portion of a further embodiment of a thin film interconnect circuit layer 138 that can be used with an electrically conductive or non-conductive diaphragm layer 137. The thin film interconnect circuit layer 138 includes a conformal blanket dielectric layer 213, a conformal patterned conductive layer 215 disposed on the conformal blanket dielectric layer 213, and a conformal conductive mesa layer 211 comprising a plurality of conductive mesas overlying the patterned conformal conductive layer 215. The conductive mesas and the underlying portions of the conformal conductive layer 215 form raised contact regions or pads 191. The interconnect circuit layer 138 can further include a patterned dielectric layer 217 having openings 217A through which the raised contact pads 191 extend. The raised contact pads 191 are higher than the other layers of the interconnect circuit layer 138, and comprise the highest portions of the interconnect circuit layer 138. This facilitates the attachment of an electromechanical transducer 39 to each of the raised contact pads 191.

In the embodiment schematically depicted in FIG. 7, the patterned conformal mesa layer 211 can comprise a suitably patterned conformal metal layer, and the patterned conformal conductive layer 215 can also comprise a suitably patterned conformal metal layer, for example.

Since the blanket dielectric layer 213, the patterned conductive layer 215, and the mesa layer 211 are conformal layers, the top surfaces of the raised contact pads 191 have a roughness that generally conforms to the roughened surface of the bonding region 137A of the metal diaphragm 137. The electromechanical transducers 39 are attached to respective contact pads 191 by a thin adhesive layer 221 that is sufficiently thin such that asperity contacts are formed between the top surfaces of the raised contact pads 191 and the electromechanical transducers 39.

Figure 8:
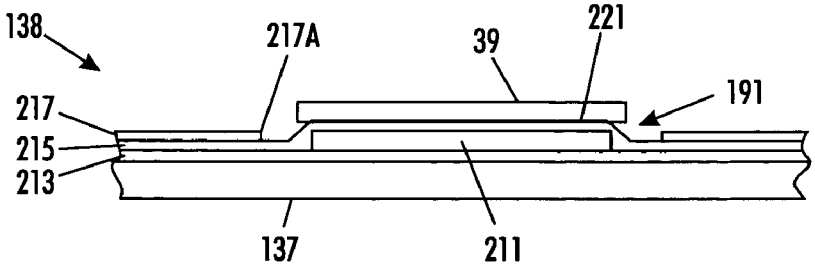
FIG. 8 is a schematic elevational sectional view of a portion of a further embodiment of a thin film interconnect circuit of the ink jet printhead assembly.

FIG. 8 is a schematic elevational sectional view of a portion of a further embodiment of a thin film interconnect circuit layer 138 that can be used with an electrically conductive or non-conductive diaphragm 137. The interconnect circuit layer 138 includes a conformal blanket dielectric layer 213, a mesa layer 211 comprising a plurality of mesas overlying the conformal blanket dielectric layer 213, and a conformal patterned conductive layer 215 overlying the mesa layer 211. The mesa layer 211 can be electrically non-conductive (e.g., dielectric) or conductive (e.g., metal). The mesas and the overlying portions of the patterned conformal conductive layer 215 form raised contact regions or pads 191. The thin film interconnect circuit layer 138 can further include a patterned dielectric layer 217 having openings 217A through which the raised contact pads 191 extend. The raised contact pads 191 are higher than the other layers of the interconnect circuit layer 138, and comprise the highest portions of the interconnect layer 138. This facilitates the attachment of an electromechanical transducer 39 to each of the raised contact pads 191.

In the embodiment schematically depicted in FIG. 8, the conformal mesa layer 211 can comprise a suitably patterned conformal dielectric layer or conformal metal layer, for example. The patterned conformal conductive layer 215 can comprise a patterned conformal metal layer.

Since the blanket dielectric layer 213, the mesa layer 211, and the patterned conductive layer 215 are conformal layers, the top surfaces of the raised contact pads 191 have a roughness that generally conforms to the roughened surface of the bonding region 137A of the metal diaphragm 137. The electromechanical transducers 39 are attached to respective contact pads 191 by a thin adhesive layer 221 that is sufficiently thin such that asperity contacts are formed between the top surfaces of the raised contact pads 191 and the electromechanical transducers 39.

Figure 9:
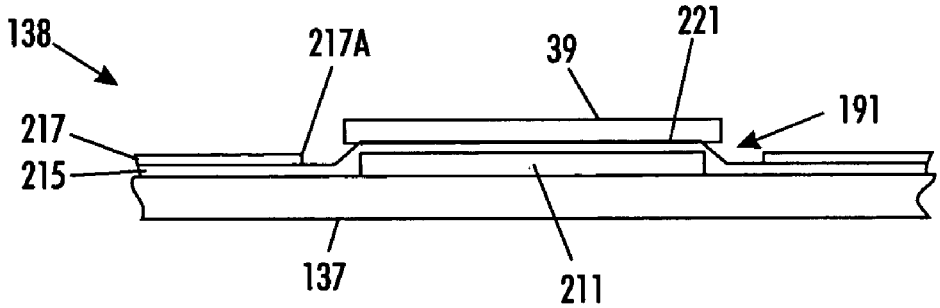
FIG. 9 is a schematic elevational sectional view of a portion of an embodiment of a thin film interconnect circuit of the ink jet printhead assembly.

FIG. 9 is a schematic elevational sectional view of a portion of an embodiment of a thin film interconnect circuit layer 138 that can be used with an electrically non-conductive diaphragm 137. The thin film interconnect circuit layer 138 includes a conformal mesa layer 211 comprising a plurality of mesas disposed on the bonding region 137A of the electrically non-conductive diaphragm 137, and a patterned conformal conductive layer 215 overlying the mesa layer 211. The mesa layer 211 can be electrically non-conductive (e.g., dielectric) or conductive (e.g., metal). The mesas and the overlying portions of the patterned conformal conductive layer 215 form raised contact regions or pads 191. The thin film interconnect circuit layer 138 can further include a patterned dielectric layer 217 having openings 217A through which the raised contact pads 191 extend. The raised contact pads 191 are higher than the other layers of the interconnect layer 138, and comprise the highest portions of the interconnect layer 138. This facilitates the attachment of an electromechanical transducer 39 to each of the raised contact pads 191.

In the embodiment schematically depicted in FIG. 9, the conformal mesa layer 211 can comprise a suitably patterned conformal dielectric layer or patterned conformal metal layer, for example. The patterned conformal conductive layer 215 can comprise a patterned conformal metal layer, for example.

Since the mesa layer 211 and the patterned conductive layer 215 are conformal layers, the top surfaces of the raised contact pads 191 have a roughness that generally conforms to the roughened surface of the bonding region 137A of the metal diaphragm 137. The electromechanical transducers 39 are attached to respective contact pads 191 by a thin adhesive layer 221 that is sufficiently thin such that asperity contacts are formed between the top surfaces of the raised contact pads 191 and the electromechanical transducers 39.

Figure 10:
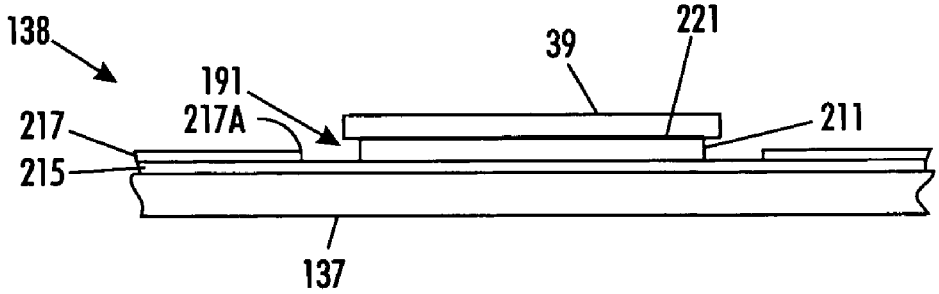
FIG. 10 is a schematic elevational sectional view of a portion of another embodiment of a thin film interconnect circuit of the ink jet printhead assembly.

FIG. 10 is a schematic elevational sectional view of a portion of a further embodiment of a thin film interconnect circuit layer 138 that can be used with an electrically non-conductive diaphragm layer 137. The thin film interconnect circuit layer 138 includes a patterned conformal conductive layer 215 and a conductive mesa layer 211 comprising a plurality of mesas overlying the patterned conformal conductive layer 215. The conductive mesas and the underlying portions of the patterned conformal conductive layer 215 form raised contact regions or pads 191. The thin film interconnect circuit layer 138 can further include a patterned dielectric layer 217 having openings 217A through which the raised contact pads 191 extend. The raised contact pads 191 are higher than the other layers of the thin film interconnect circuit layer 138, and comprise the highest portions of the interconnect layer 138. This facilitates the attachment of an electromechanical transducer 39 to each of the raised contact pads 191.

In the embodiment schematically depicted in FIG. 10, the patterned conformal conductive mesa layer 211 can comprise a suitably patterned conformal metal layer, and the patterned conformal conductive layer 215 can also comprise a suitably patterned conformal metal layer, for example.

Since the patterned conductive layer 215 and the conductive mesa layer 211 are conformal layers, the top surfaces of the raised contact pads 191 have a roughness that generally conforms to the roughened surface of the bonding region 137A of the metal diaphragm 137. The electromechanical transducers 39 are attached to respective contact pads 191 by a thin adhesive layer 221 that is sufficiently thin such that asperity contacts are formed between the top surfaces of the raised contact pads 191 and the electromechanical transducers 39.

Each dielectric layer of the thin film interconnect circuit layer 138 can comprise silicon oxide, silicon nitride, or silicon oxynitride, for example, and can have a thickness in the range of about 0.1 micrometers of about 5 micrometers. More specifically, each dielectric layer can have a thickness in the range of about 1 micrometers to about 2 micrometers.

Each conductive layer of the thin film interconnect circuit layer 138 can comprise aluminum, chromium, nickel, tantalum or copper, for example, and can have a thickness in the range of about 0.1 micrometers of about 5 micrometers. More specifically, each conductive layer can have a thickness in the range of about 1 micrometers to about 2 micrometers.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A drop emitting apparatus comprising:

a fluid channel layer;

a diaphragm layer disposed on the fluid channel layer;

a roughened bonding region formed on a surface of the diaphragm layer;

a thin film circuit having conformal raised contact regions disposed on the roughened bonding region; and a plurality of electromechanical transducers adhesively attached to the conformal raised contact regions and electrically connected to the conformal raised contact regions by asperity contacts formed between the conformal raised contact regions and the electromechanical transducers.

2. The drop emitting apparatus of claim 1 wherein the roughened bonding region has a roughness average in the range of about 1 microinch to about 100 microinches.

3. The drop emitting apparatus of claim 1 wherein the roughened bonding region has a roughness average in the range of about 5 microinches to about 20 microinches.

4. The drop emitting apparatus of claim 1 wherein the roughened bonding region has a roughness average in the range of about 30 microinches to about 80 microinches.

5. The drop emitting apparatus of claim 1 wherein the raised contact regions have a top surface roughness average in the range of about 1 microinch to about 100 microinches.

6. The drop emitting apparatus of claim 1 wherein the raised contact regions have a top surface roughness average in the range of about 5 microinches to about 20 microinches.

7. The drop emitting apparatus of claim 1 wherein the raised contact regions have a top surface roughness average in the range of about 30 microinches to about 80 microinches.

8. The drop emitting apparatus of claim 1 wherein the raised contact areas include conformal dielectric mesas.

9. The drop emitting apparatus of claim 1 wherein the raised contact areas include conformal conductive mesas.

10. The drop emitting apparatus of claim 1 wherein the thin film circuit comprises a conformal mesa layer and a patterned conformal conductive layer overlying the conformal mesa layer.

11. The drop emitting apparatus of claim 1 wherein the thin film circuit comprises blanket conformal dielectric layer, a conformal mesa layer overlying the blanket conformal dielectric layer, and a patterned conformal conductive layer overlying the conformal mesa layer.

12. The drop emitting apparatus of claim 1 wherein the thin film circuit comprises a conformal mesa layer, a blanket dielectric conformal layer overlying the conformal mesa layer, and a patterned conformal conductive layer overlying the blanket conformal dielectric layer.

13. The drop emitting apparatus of claim 1 wherein the thin film circuit comprises a patterned conformal conductive layer and a conformal conductive mesa layer overlying the patterned conformal conductive layer.

14. The drop emitting apparatus of claim 1 wherein the thin film circuit comprises a blanket conformal dielectric layer, a patterned conformal conductive layer overlying the blanket conformal dielectric layer, and a conformal conductive mesa layer overlying the patterned conformal conductive layer.

15. The drop emitting apparatus of claim 1 wherein the roughened bonding region comprises a particle blasted region.

16. The drop emitting apparatus of claim 1 wherein the roughened bonding region comprises a laser roughened region.

17. The drop emitting apparatus of claim 1 wherein the fluid channel layer receives melted solid ink.

18. The drop emitting apparatus of claim 1 wherein the electromechanical transducers comprise piezoelectric transducers.

19. The drop emitting apparatus of claim 1 wherein the fluid channel layer comprises a stack of patterned metal plates.

20. A drop emitting apparatus comprising:

a fluid channel layer;

a metal diaphragm layer attached to the fluid channel layer;

a roughened bonding region formed on a surface of the metal diaphragm layer;

a thin film circuit having conformal raised contact regions disposed on the roughened bonding region;

wherein the conformal raised contact regions include conformal mesas; and a plurality of piezoelectric transducers adhesively attached to the conformal raised contact regions and electrically connected to the conformal raised contact regions by asperity contacts formed between the conformal raised contact regions and the piezoelectric transducers.

21. The drop emitting apparatus of claim 20 wherein the roughened bonding region has a roughness average in the range of about 1 microinch to about 100 microinches.

22. The drop emitting apparatus of claim 20 wherein the roughened bonding region has a roughness average in the range of about 5 microinches to about 20 microinches.

23. The drop emitting apparatus of claim 20 wherein the roughened bonding region has a roughness average in the range of about 30 microinches to about 80 microinches.

24. The drop emitting apparatus of claim 20 wherein the raised contact regions have a top surface roughness average in the range of about 1 microinch to about 100 microinches.

25. The drop emitting apparatus of claim 20 wherein the raised contact regions have a top surface roughness average in the range of about 5 microinches to about 20 microinches.

26. The drop emitting apparatus of claim 20 wherein the raised contact regions have a top surface roughness average in the range of about 30 microinches to about 80 microinches.

27. The drop emitting apparatus of claim 20 wherein the conformal mesas comprise conformal dielectric mesas.

28. The drop emitting apparatus of claim 20 wherein the conformal mesas comprise conformal conductive mesas.

29. The drop emitting apparatus of claim 20 wherein the thin film circuit comprises blanket conformal dielectric layer, a conformal mesa layer overlying the blanket conformal dielectric layer, and a patterned conformal conductive layer overlying the conformal mesa layer.

30. The drop emitting apparatus of claim 20 wherein the thin film circuit comprises a conformal mesa layer, a blanket dielectric conformal layer overlying the conformal mesa layer, and a patterned conformal conductive layer overlying the blanket conformal dielectric layer.

31. The drop emitting apparatus of claim 20 wherein the thin film circuit comprises a blanket conformal dielectric layer, a patterned conformal conductive layer overlying the blanket conformal dielectric layer, and a conformal conductive mesa layer overlying the patterned conformal conductive layer.

32. The drop emitting apparatus of claim 20 wherein the roughened bonding region comprises a particle blasted region.

33. The drop emitting apparatus of claim 20 wherein the roughened bonding region comprises a laser roughened region.

34. The drop emitting apparatus of claim 20 wherein the fluid channel layer receives melted solid ink.

35. The drop emitting apparatus of claim 20 wherein the electromechanical transducers comprise piezoelectric transducers.

36. The drop emitting apparatus of claim 20 wherein the fluid channel layer comprises a stack of patterned metal plates.

37. A drop generator comprising:

a pressure chamber;

a metal diaphragm forming a wall of the pressure chamber, the metal diaphragm including a roughened bonding surface;

a thin film conformal raised contact region disposed on the roughened bonding surface;

a piezoelectric transducer adhesively attached to the conformal raised contact region and electrically connected to the conformal raised contact region by asperity contacts formed between the conformal raised contact region and the piezoelectric transducer;

an outlet channel connected to the pressure chamber; and a drop emitting nozzle disposed at an end of the outlet channel.

38. The drop generator of claim 37 wherein the roughened bonding region has a roughness average in the range of about 1 microinch to about 100 microinches.

39. The drop emitting apparatus of claim 37 wherein the roughed bonding region has a roughness average in the range of about 5 microinches to about 20 microinches.

40. The drop emitting apparatus of claim 37 wherein the roughened bonding region has a roughness average in the range of about 30 microinches to about 80 microinches.

41. The drop emitting apparatus of claim 37 wherein the raised contact regions have a top surface roughness average in the range of about 1 microinch to about 100 microinches.

42. The drop emitting apparatus of claim 37 wherein the raised contact regions have a top surface roughness average in the range of about 5 microinches to about 20 microinches.

43. The drop emitting apparatus of claim 37 wherein the raised contact regions have a top surface roughness average in the range of about 30 microinches to about 80 microinches.

44. The drop generator of claim 37 wherein the raised contact region includes a conformal dielectric mesa.

45. The drop generator of claim 37 wherein the raised contact region includes a conformal conductive mesa.

46. The drop generator of claim 37 wherein the raised contact region comprises a conformal dielectric layer, a conformal mesa on the conformal dielectric layer, and a conformal conductive layer on the conformal mesa.

47. The drop generator of claim 37 wherein the raised contact region comprises a conformal mesa, a conformal dielectric layer on the conformal mesa, and a conformal conductive layer on the conformal dielectric layer.

48. The drop generator of claim 37 wherein the raised contact region comprises a conformal dielectric layer, a conformal conductive layer on the conformal dielectric layer, and a conformal conductive mesa on the conformal conductive layer.

49. The drop generator of claim 37 wherein the roughened bonding region comprises a particle blasted region.

50. The drop generator of claim 37 wherein the roughened bonding region comprises a laser roughened region.

51. The drop generator of claim 37 wherein the pressure chamber receives melted solid ink.

52. The drop generator of claim 37 wherein the pressure chamber and the outlet channel are formed in a stack of patterned metal plates.

53. A method of making a drop emitting apparatus comprising:

roughening a region of a surface of a diaphragm layer;

forming on the roughened region a thin film circuit having conformal raised contact regions; and adhesively attaching piezoelectric transducers to the conformal raised contact regions and forming asperity contacts between the conformal raised contact regions and the piezoelectric transducers.

54. The method of claim 53 wherein roughening a region of a surface of a diaphragm layer comprises particle blasting a region of a surface of a diaphragm layer.

55. The method of claim 53 wherein roughening a region of a surface of a diaphragm layer comprises laser roughening a region of a surface of a diaphragm layer.

* * * * *